US011473839B2

(12) United States Patent
Pachnatz

(10) Patent No.: US 11,473,839 B2
(45) Date of Patent: Oct. 18, 2022

(54) FREEZE-DRYING SYSTEM AND METHOD THEREFOR

(71) Applicant: Torsten Pachnatz, Erfurt (DE)

(72) Inventor: Torsten Pachnatz, Erfurt (DE)

( * ) Notice: Subject to any disclaimer, the term of this patent is extended or adjusted under 35 U.S.C. 154(b) by 96 days.

(21) Appl. No.: 17/045,328

(22) PCT Filed: Dec. 6, 2018

(86) PCT No.: PCT/EP2018/083783

§ 371 (c)(1),
(2) Date: Oct. 5, 2020

(87) PCT Pub. No.: WO2019/192747

PCT Pub. Date: Oct. 10, 2019

(65) Prior Publication Data

US 2021/0172679 A1 Jun. 10, 2021

(30) Foreign Application Priority Data

Apr. 5, 2018 (DE) ..... 102018002776.8

(51) Int. Cl.

| | |
|---|---|
| ***F26B 5/06*** | (2006.01) |
| ***F26B 5/02*** | (2006.01) |
| ***F26B 5/04*** | (2006.01) |
| ***F26B 23/10*** | (2006.01) |

(52) U.S. Cl.

CPC ..... *F26B 5/06* (2013.01); *F26B 5/02* (2013.01); *F26B 5/044* (2013.01); *F26B 23/10* (2013.01)

(58) Field of Classification Search

CPC .... F26B 5/06; F26B 5/02; F26B 5/044; F26B 23/10

USPC ..... 34/92, 291, 284

See application file for complete search history.

(56) References Cited

U.S. PATENT DOCUMENTS 3,088,222 A * 5/1963 Mace ..... F26B 5/06 34/92
3,281,954 A * 11/1966 Baer ..... F26B 5/06 34/92
4,016,657 A * 4/1977 Passey ..... F25B 49/00 62/324.3

(Continued)

FOREIGN PATENT DOCUMENTS

CN 103968649 A 8/2014
EP 3093597 A1 11/2016

(Continued)

OTHER PUBLICATIONS

International Search Report dated Mar. 4, 2019; International Application No. PCT/EP2018/083783.

*Primary Examiner* — Stephen M Gravini
(74) *Attorney, Agent, or Firm* — Dinsmore & Shohl LLP

(57) ABSTRACT

The invention relates to a freeze-drying system for drying products containing liquid and to a method for operating a freeze-drying system, said freeze-drying system having a vacuum chamber, in which at least one holding device for holding the products containing liquid is inserted, a coolable condenser being provided, on which liquid drawn from the product in a drying phase can be condensed from a vapor phase. According to the invention, at least one sound generator is arranged on the holding device, by means of which sound generator sound can be applied to the product during the drying phase.

7 Claims, 4 Drawing Sheets

(56) References Cited

U.S. PATENT DOCUMENTS

| | | | | | |
|---|---|---|---|---|---|
| 5,105,557 | A * | 4/1992 | Vadasz | F26B 5/02 | 34/426 |
| 6,233,844 | B1 * | 5/2001 | Gallego Juarez | F26B 7/00 | 34/256 |
| 7,836,606 | B2 * | 11/2010 | Gehrmann | F26B 5/065 | 34/284 |
| 8,516,714 | B2 * | 8/2013 | Biemans | A61K 9/19 | 62/50.7 |
| 9,671,166 | B2 * | 6/2017 | Plavnik | F25D 25/04 | |
| 2021/0172679 | A1 * | 6/2021 | Pachnatz | F26B 5/06 | |
| 2021/0239396 | A1 * | 8/2021 | Tang | F26B 5/044 | |

FOREIGN PATENT DOCUMENTS

| | | | | | |
|---|---|---|---|---|---|
| FR | 2654810 | A1 * | 11/1989 | | |
| GB | 948517 | A | 2/1964 | | |
| GB | 2255164 | A * | 10/1992 | A01N 1/02 | |
| GB | 2400901 | A | 10/2004 | | |
| JP | S61178185 | U | 11/1986 | | |
| JP | S63132292 | U | 8/1988 | | |
| JP | H7180955 | A | 7/1995 | | |
| WO | WO-2019192747 | A1 * | 10/2019 | F26B 23/10 | |
| WO | WO-2021114694 | A1 * | 6/2021 | C12P 19/04 | |

* cited by examiner

PRIOR ART

FREEZE-DRYING SYSTEM AND METHOD THEREFOR

CROSS-REFERENCE TO RELATED APPLICATIONS

This application is the U.S. national stage of PCT/EP2018/083783 filed Dec. 6, 2018, which claims priority of German patent application 102018002776.8 filed Apr. 5, 2018, both of which are hereby incorporated by reference in their entirety.

FIELD OF THE INVENTION

The invention relates to a freeze-drying system for drying products containing liquid, i.e. generally products containing a solvent, and the invention relates to a method of drying such products using such a freeze-drying system. The freeze-drying system is designed with a vacuum chamber in which at least one reception device for receiving the products is introduced and wherein a coolable condenser is present at which liquid withdrawn from the product in a drying phase can be precipitated from a vapor phase.

BACKGROUND OF THE INVENTION

Freeze-drying, that is known per se, is a method for the gentle evaporation of the most varied solvents that are, for example, present in foodstuffs, in medicines, and the like as a condition of manufacturing or in a natural manner.

Freeze-drying systems serve the performance of the method of freeze-drying and the drying takes place by the evaporation of the solvent in the product itself. The solvent, and thus frozen liquid, in this process changes directly and without any prior transition into the liquid phase from the frozen state into the gaseous state, which is called sublimation. The liquid can already be sublimated at considerably lower temperatures by the generation of a vacuum so that the product is not subject to high thermal load. The low thermal load in this process enables the maintenance of the properties of the product, for example the maintenance of oils, aromas, and further, preferably flavorful, properties, as well as of the consistency of the product.

A known example for the use of freeze-drying is the manufacture of so-called instant coffee that is manufactured using freeze-drying, in particular also to maintain the aromatic substances in soluble coffee for later consumption. In addition to the maintenance of the original properties of the products, the excellent solubility of the freeze-dried product and the storage at room temperature are above all advantageous.

Freeze-drying systems as a rule comprise a vacuum chamber for receiving the products, for which purpose spaces that can be cooled and heated are accommodated in the vacuum chamber and a condenser is provided that is as a rule accommodated in a condenser chamber separable from the reception space. The product is first frozen, kept frozen, and introduced into the vacuum chamber that is subsequently closed and evacuated. The product is then heated under the generated vacuum and sublimation energy consumed in the course of the drying is supplied again. The condenser in this process is cooled to low temperatures by a refrigeration unit, in particular using a refrigerant to again condense the liquid sublimated from the product from the vapor phase on the surface of the condenser. Versatile parameters such as the cooling rate, the freezing temperature, the vacuum in the vacuum chamber, the space temperature for receiving the products, and, for example, the length of the main drying enter into the freeze-drying process, whereby the complexity of the method already becomes clear. Due to the complex process procedure, a precise measurement and control technique for the detection of the temperature and of the pressure as well as of further parameters is required for the optimization of the freeze-drying process.

The freeze-drying is generally divided into three part steps that are delineated from one another in time, that is the freezing, the main drying, and the final drying. The liquid is frozen by the lowering of the temperature in the product, with it having to be noted that the freezing point of the liquid is further lowered by the dissolved substances. The vacuum is then generated and the pressure is lowered to a value that is below the freezing point of the liquid in the phase diagram. The pressure value to be set is substantially oriented on the liquid temperature to be maintained and is determined with the aid of the vapor pressure curve.

The actual drying process takes place exclusively by sublimation of liquid in the product under the set pressure vacuum. The sublimation energy consumed in the main drying for the removal of the liquid from the product is supplied to the product again in the form of heat in the reception apparatus. For this purpose, the reception apparatus as a rule have reception plates and a conducting device and a fluid can be conducted via the conducting device through corresponding fluid passages in the reception plate. Silicone oil is used as the fluid, for example. As the drying of the product progresses, the layer thickness of the dried product also grows from the outside to the inside in this process and the sublimation rate decreases. To maintain the sublimation, the space temperature on the surface of the reception plates is continuously increased, with the maximum temperature, however, being limited in order not to damage the product, in particular such that no thawing of the product occurs. Pressures of, for example, 1 mbar to 10 mbar are typical in the main drying here. In the final drying, the remaining liquid that is still bound in the product matrix is withdrawn. In practice, the temperature of the spaces on the reception plates is increased still further here while the lowest achievable pressure in the vacuum chamber of, for example, 3 mbar to 10 mbar is implemented.

Known freeze-drying systems are designed such that the vacuum chamber, for example, is separated from the condenser chamber by an intermediate wall or has another separation from the condenser chamber and the vacuum chamber is connected to the condenser chamber via an openable valve that is, for example, introduced in the intermediate wall. Once the sublimation has started and the vapor pressure in the vacuum chamber increases, the valve is opened and the solvent vapor, for example water vapor, can pass into the condenser chamber and precipitate at the surface of the condenser. The condensers, for example, comprise cooling coils and are cooled via a compressor to low temperatures by a refrigerant. After the end of the drying process, the vacuum chamber and as a rule also the condenser chamber are vented to normal pressure again. A vacuum connection via which the vacuum chamber and/or the condenser chamber can be connected to an external compressor serves to vent the vacuum chamber and/or the condenser chamber.

FIG. 1, for example, shows a freeze-drying system 1 in accordance with the prior art for drying products 10 containing liquid. The freeze-drying system 1 has a vacuum chamber 11 and a condenser chamber 25 that is by way of example separated from the vacuum chamber 11 by an intermediate wall 21. A reception space 15 in which a reception apparatus 12 for receiving the product 10 is introduced in the vacuum chamber 11. The reception apparatus 12 has a plurality of reception plates 15 and the reception apparatus 12 comprises a conducting device 19 having a plurality of fluid lines 24.

A condenser 13 is introduced in the condenser chamber 25 and the condenser chamber 25 can be connected to the reception space 15 of the vacuum chamber 11 in that a valve 22 in the intermediate wall 21 is opened.

At the start of the drying process, the products 10 are placed onto the reception plates in the frozen state. The vacuum chamber 11 is subsequently closed and a vacuum is generated in the vacuum chamber 11. The sublimation subsequently starts, with the temperature of the product 10 being raised as its degree of drying increases. The conducting device 19 having the fluid lines 24 through which a fluid 20, for example silicone oil, can be conducted serves this purpose. The placement spaces on the condenser plates 16 and thus also the products 10 can be correspondingly heated by means of the fluid 20 that is temperature controlled outside the vacuum chamber 11. As the degree of drying of the products 10 increases, the temperature in the products 10 is also increased via the fluid 20 in this process, with the valve 22 being opened as the vapor pressure in the reception space 15 increases and the vapor phase of the liquid, for example water vapor or generally solvent vapor, being able to condense at the surface of the condenser 13. A replacement of the atmosphere in the reception space 15 with the atmosphere in the condenser chamber 25 takes place in this process. Once the drying has also taken place with the further final drying phase with a simultaneously further heating of the products 10, the vacuum connection 26 is opened and the reception space 15 and the condenser chamber 25 are vented again with a simultaneous opening of the valve 22. The dried product 10 can subsequently be removed.

The reception apparatus 12 can have a plurality of reception plates 16 that are arranged above one another and whose spacing from one another can be varied by a corresponding actuator system. Vessels for pharmaceutical products, for example, can thus be automatically closed after the drying, in particular to achieve a sterile provision of the dried product 10.

If the products in the reception apparatus are in a resting state, the problem can occur that liquid portions in the product interior can only be removed from the product with difficulty. To overcome this disadvantage, GB 948 517 A proposes a milling or a grinding of the product 10 and the milled or ground product, for example instant coffee, is conducted over vibrating reception plates so that the product to be dried remains in motion during the drying phase, in particular to utilize a large surface of the milled or ground product effectively for drying. The milling or grinding of a product is, however, not possible for every product and there are some products, for example medicines, that have to be applied to the reception plates of the reception apparatus in stored form, for instance, and have, for example, a powder-like consistency that is, however, still bound to solvent.

The use of ultrasound to improve the drying process is generally known in freeze-drying systems. The influence of ultrasound on the product improves the permeability of the product to be dried so that the liquid can also sublimate better from inner regions of the product. The influence of ultrasound on the substance transport process on the drying of the products in this process is based on the minimizing of internal and external resistances for the thermal and substance transport so that the diffusion barriers are reduced and boundary layer formation is alleviated. The implosion of gas bubbles known as cavitation and caused by the cyclic alternating pressure and microflows resulting therefrom can above all influence boundary layers and thus reduce external resistances to the substance transport in the product and the substance transition at the product surface. Ultrasound is here provided as accompanying support of the drying of the product during the drying phase. Further details can be seen from the German language AiF 17161 N: "Improving drying processes of vegetable raw materials by process-induced reduction of substance transport resistances", Forschungskreis der Ernährungsindustrie e.v. (FEI), Bonn.

The treatment of the product with ultrasound as a rule takes place by a sound generator arranged outside the vacuum chamber so that the direct influencing of the product by the ultrasound can only be reached to a limited extent. It is in particular customary to sonfiy the product with ultrasound before the introduction into the vacuum chamber, in particular in the freezing phase, to promote ice crystallization in the freezing process of the liquid, whereby the subsequent sublimation in the vacuum chamber can be improved. To promote the drying process of the product in the vacuum chamber and under vacuum atmosphere, the ultrasound is as a rule no longer used as an accompaniment thereto.

SUMMARY OF THE INVENTION

The object of the invention is an improvement of a freeze-drying system for drying products containing liquid and the improvement of a method of drying products containing liquid using such a freeze-drying system. The use of ultrasound as a supporting medium in the drying of the products containing liquid should in particular be used in improved form, preferably to accelerate the drying process and to achieve a simpler setup of the freeze-drying system as a result.

This object is achieved starting from a freeze-drying system for drying products containing liquid by the respective characterizing features as described herein and starting from a method of drying products containing liquid using such a freeze-drying system as also described herein. Advantageous further developments of the invention are also set forth.

The invention provides for the improvement of the freeze-drying system the arrangement of at least one sound generator at the reception apparatus by which the product can be treated with sound during the drying phase.

The core of the invention is the arrangement of the sound generator at at least one arrangement point of the reception apparatus that is introduced in the vacuum chamber so that the sound generator is thus also arranged in the reception space of the vacuum chamber, but the possibility also remains open of arranging the sound generator outside the reception space when a housing part of the vacuum chamber is also a component of the reception apparatus. If the sound generator is attached to a separate retaining means within the reception space and if it treats the product or products with sound from such a position, the reception apparatus thus also includes such a retaining means in the sense of the present invention so that ultimately the sound generator is then also arranged at the reception apparatus.

The reception apparatus can have one or more reception plates in the sense of the invention, with the invention also starting from the idea that the reception apparatus can, for instance, comprise a conducting device and further conversion parts through which a fluid can be conducted, in particular to cool or to heat the reception plates. The reception apparatus in the sense of the invention can here comprise a plurality of levels for the placement of the products or the reception apparatus is formed in multiple parts and has a base plate on which one or more bowls are arranged in which the products are disposed. The products can here be medicines or, for example, foodstuffs that are in particular laid out individually and unpackaged on the reception plate at least indirectly therewith. To this extent, the sound generator can be arranged at any possible component of the reception apparatus.

If the at least one sound generator is operated within the evacuated vacuum chamber during the drying phase, the sound generator can directly sonfiy the product and influence it such that the drying can run in a considerably accelerated manner. Less energy is required due to the accelerated drying process and the sending of ultrasound into the product can in particular contribute to the heating of the product, with the heating being able to take place directly at the point of sublimation without a thermal conducting first having to pass, for example from the reception plate via a container of the product to the product itself. The drying process can thereby in particular be substantially accelerated, which only becomes possible when the sound generator is positioned in an at least indirect arrangement, and in particular in a direct arrangement, at the reception apparatus so that the sound generator can be arranged as close as possible to the product.

A further aspect of the freeze-drying system in accordance with the invention is directed to the fact that the reception space is formed in the vacuum chamber in which the reception apparatus is located with the product or products, with the condenser also still being able to be received in the reception space as a further aspect of the invention. The vacuum chamber thus forms a single reception space in which both the reception apparatus with the product or products and simultaneously the condenser are received, whereby the setup of the system is simplified. Consequently, the intermediate wall having the valve can be dispensed with, with only a vacuum connection for evacuation and venting being able to be present via which the vacuum can be maintained at the required pressure values, in particular when a corresponding compressor is attached to the vacuum connection. The invention is, however, also directed to freeze-drying systems that have a condenser chamber that is only connectable to the vacuum chamber on the opening of the valve.

If the reception apparatus comprises one or more reception plates, the at least one product can be placed on an upper side of the reception plate, and with the at least one sound generator being arranged at a lower side of the reception plate disposed opposite the upper side. If the products are, for example, received in containers, in vessels, in bowls, or the like and if they are placed on the reception plate at the upper side with it or them, a plurality of sound generators can be provided that are each directly arranged beneath the products at the lower side at the reception plate. If the sound generators are put into operation, they can send this sound, in particular ultrasound, into the reception plane and through it into the product during the drying phase. The basic idea of the invention is in particular reproduced in that the sound generators at least indirectly send sound into the reception plates such that the solid-borne noise in the reception plate can enter into the product. The sound generator can, for example, comprise a sonotrode that is directly connected to the reception plate so that the sound, in particular ultrasound, can be directly introduced into the reception plate. It is also conceivable that the reception plate is in multiple parts here and that the sound is transferred from structure to structure of the multipart reception plate. Such a transfer can in particular take place from the reception plate into a reception bowl or another reception vessel for receiving the product.

Sound generators in the sense of the present invention designate all technical devices that are suitable to introduce a sound, in particular an ultrasound, into a substance, that is a liquid or a solid, and to set it into vibration. In this respect, the sound generator can also be in multiple parts and only a sonotrode is arranged at the reception apparatus, and a corresponding generator that is only connected to the sonotrode comprising the exciter by means of an electrical line. The generator here does not likewise have to be arranged in the reception space of the vacuum chamber since it is sufficient that the sonotrode with the sound exciter is arranged at the reception apparatus.

Sound generators, and thus the part of the sound generator arrangeable at the reception apparatus in the sense of the invention, can be configured as parallelepipeds, as disks, as cylinders, or as other components that, with dimensions of, for example, a few centimeters, can easily be attached to the reception apparatus. The sound generators are, for example, designed as round or angular disks or plates that have lateral dimensions that approximately correspond to the placement dimensions of the containers in which the products are received.

The condenser of the freeze-drying system is particularly advantageously configured as a cooling coil and has a pipeline or is formed by a pipeline through which a refrigerant is conducted when the freeze-drying system is operated and the condenser is cooled. The condenser, in particular in the form of the cooling coil, can here be configured spatially such that it surrounds the reception apparatus at the outside. A compact construction can in particular be achieved in this manner if, in accordance with a possible embodiment, both the reception apparatus with the products and the condenser are accommodated in a common reception space of the vacuum chamber.

In accordance with a modification of the embodiment of the freeze-drying system in accordance with the invention, there is the possibility that the reception apparatus comprises a reception plate that is formed by means of a base plate of the vacuum chamber. In this respect, the sound generator can be arranged below the base plate and thus outside the vacuum chamber and the product can be disposed on the base plate so that the sound generator can send sound into the product through the reception plate formed with the base plate. If the product is placed on the base plate of the vacuum chamber that simultaneously forms the boundary of the reception space at the lower side, the setup of the freeze-drying system is thus simplified and in particular the setup of the reception apparatus is further simplified. Such a solution can, for example, be provided when a freeze-drying system that has ultrasound supported drying is rather small in construction is to be provided.

In accordance with a variant of the freeze-drying system, the reception apparatus comprises a conducting device for conducting a fluid, with the sound generator also being able to be arranged at the conducting device to sonfiy sound into the fluid. The sound can be conducted from the sound generator to the reception plate via the fluid and thus via the fluid column to ultimately send sound into the product that is disposed on the reception plate. The advantage thereby results that a central sound generator can be used for a plurality of reception plates or the arrangement of the sound generator is simplified, for example when one sound generator per reception plate is arranged at a fluid line leading to the reception plate.

The sound generator, for example, forms an ultrasound generator and the latter generates a sound having a sound frequency of at least 16 kHz, for example up to 1 GHz. The sound in this process is conducted into the fluid line by means of solid-borne sound transmission into the reception plate and/or via a fluid column of the fluid and is ultimately sent in the product. Sound can in particular be sent into the fluid line and thus into the fluid column that is then transmitted into the reception plate and can finally move from it into the product.

The object of the invention is further achieved by a method of drying products containing liquid having a freeze-drying system, said method at least comprising the following steps: Arranging at least one sound generator at a reception apparatus for receiving the products containing liquid in the vacuum chamber and treating the product with sound during the drying phase by means of a sound wave conducting through at least some of the reception device by the sound generator. The further features and associated advantages listed in connection with the freeze-drying system in accordance with the invention are likewise taken into account for the method in accordance with the invention of drying products containing liquid using such a freeze-drying system.

The method is further characterized in that the sound generator is arranged at a lower side of a reception plate of the reception apparatus and the product standing on an upper side of the reception plate is treated with sound through the reception plate.

In accordance with a further alternative, the method is performed such that the receiving apparatus is formed by a conducting device for conducting a fluid, with the sound generator being arranged at the conducting device and sending a sound into the fluid so that the sound is conducted through the fluid to the reception plate and thus to the product.

The reception apparatus having the product or products and a condenser of the freeze-drying system can be received separately from one another in separate chambers or only in the vacuum chamber in a common reception space. A valve, in particular in an intermediate wall, to form a connection to the condenser space in which the condenser is arranged is thereby dispensed with. The drying process is greatly accelerated by the influence of the ultrasound in the operation of the ultrasound generator such that a single cycle can be sufficient for a complete drying of the product. There is additionally advantageously the possibility that the influence of the ultrasound, in particular due to the selection of a correspondingly higher power of the ultrasound generator, heat only has to be conducted to the product to a lesser degree via fluid, with a possible further development of a freeze-drying system and of an associated method being able to be oriented in accordance with the invention such that the heating of the product takes place completely by the influence of the ultrasound, in particular when the sound generators are operated at a higher power. The conducting device having the fluid lines and the heating and cooling fluid can thus also be dispensed with, whereby the setup of the freeze-drying system and the performance of the method are further simplified.

BRIEF DESCRIPTION OF THE DRAWINGS

Further measures improving the invention will be shown in more detail below together with the description of preferred embodiments of the invention with reference to the Figures. There are shown.

DETAILED DESCRIPTION OF THE DRAWINGS

Figure 1:
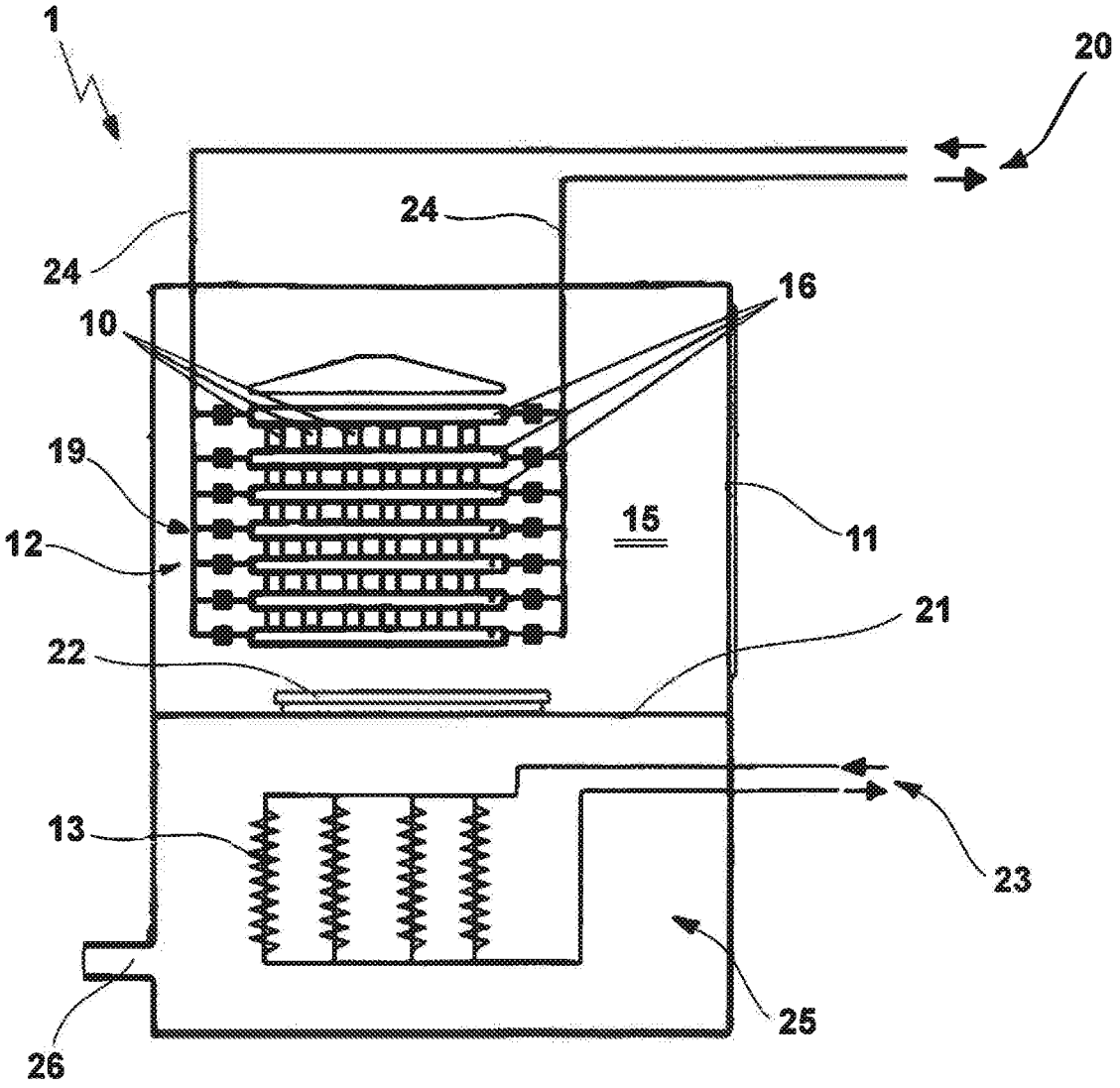
FIG. 1 is a schematic view of an embodiment of a freeze-drying system in accordance with the prior art.

FIG. 1 shows a freeze-drying system 1 in accordance with the prior art and the freeze-drying system 1 has already been looked at in detail in connection with the introductory part of the present description.

Figure 2:
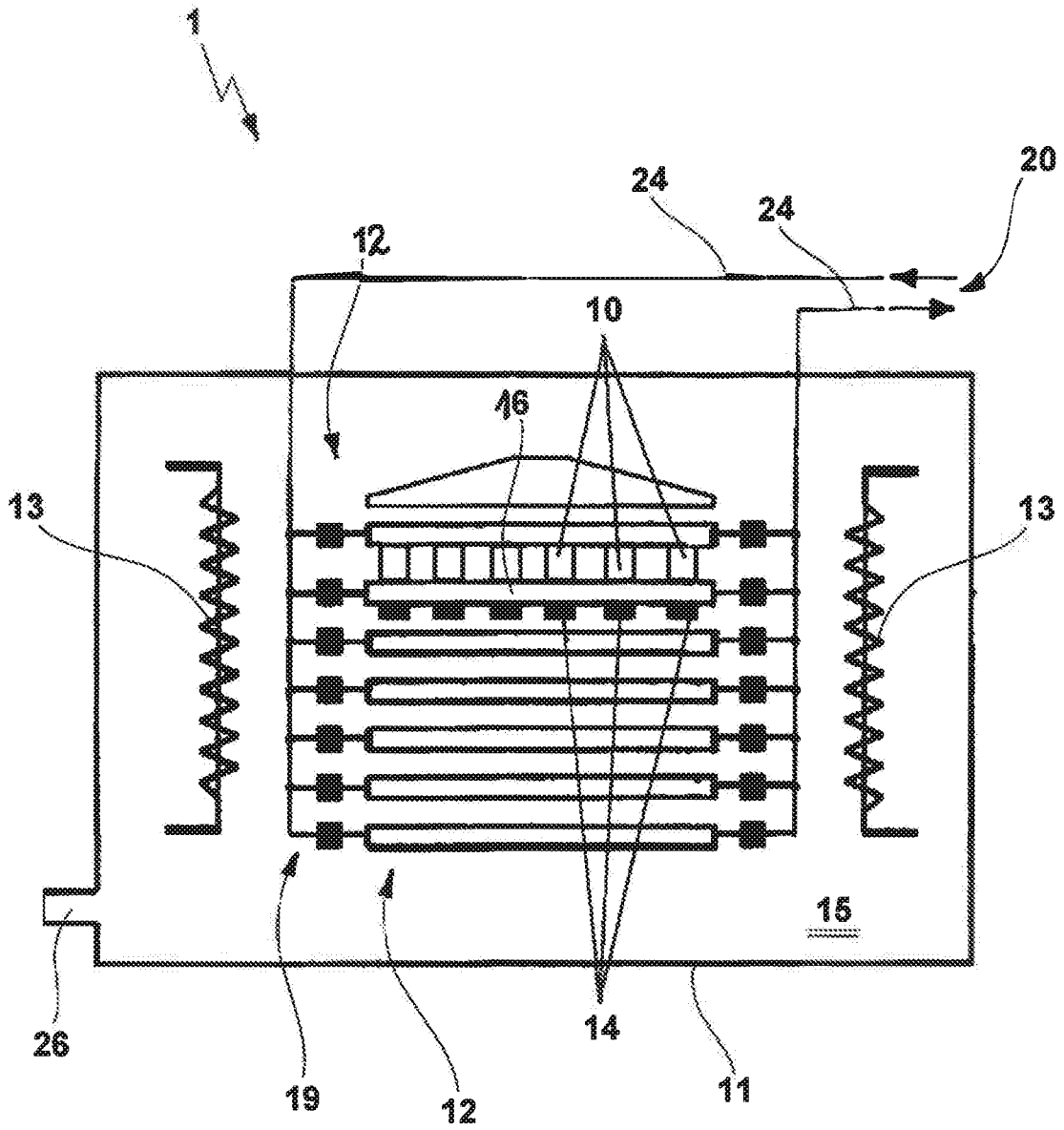
FIG. 2 is a freeze-drying system in a schematic view having the features of the invention.

FIG. 2 shows a freeze-drying system 1 in accordance with a first variant of the invention and the freeze-drying system 1 has a vacuum chamber 11 and the vacuum chamber 11 forms a reception space 15 that can be evacuated. A reception apparatus 12 for receiving products 10 to be dried is received in the reception space 15. A condenser 13, that is shown schematically and that by way of example surrounds the reception apparatus 12 at the outer side, is furthermore located in the same reception space 15.

The reception apparatus 12 has a plurality of reception plates 16 on which the products 10 to be dried are placed. A conducting device 19 having fluid lines 24 is connected to the reception plates 15 and a fluid 20, for example a silicone oil, can be conducted through the fluid lines 24. The fluid 20 can be cooled or heated by peripheral devices so that the products 10 can also be cooled, and in particular heated, by the heat exchange with the reception plates 16.

A plurality of sound generators 14 for transmitting a sound, in particular an ultrasound, are arranged below the reception plates 16 so that the products 10 placed on the reception plates 16 can be directly treated with sound by the direct arrangement of the sound generators 14 on the reception plates 16.

The vacuum chamber 11 has a vacuum connection 26 via which the vacuum chamber 11 can be evacuated or can also be vented again with the aid of further peripheral devices, not shown.

If the freeze-drying system 1 is put into operation, the products 10 can first be inserted or set into the reception apparatus 12 in the frozen state or can be introduced into the vacuum chamber 11 together with the reception apparatus 12. The vacuum chamber 11 is subsequently closed and is evacuated via the vacuum connection 26. Due to the falling phase transition point of the solid phase of the liquid in the frozen product, this can change directly into the vapor state without forming a liquid phase, whereby the product dries. If the condenser 13 is flowed through by a refrigerant, for example, it can be brought to a very low freezing temperature and the liquid vapor from the sublimation process of the product 10 can precipitate directly at the surface of the condenser 13.

If the sound generators 14 are operated during the drying phase of the products 10 and if the sound generators, for example, transmit ultrasound directly into the products 10, the sublimation of the liquid in the products 10 is considerably accelerated. The temperature can simultaneously be uniformly heated due to the ultrasound influence so that a heating accompanying this can take place additionally or alternatively to heating of the products 10 via a heated fluid 20.

In a manner not shown, the condensers can additionally be equipped with and treated by sound generators to achieve, by the effect of the sound excitement, a higher packing density of the precipitating ice from the gas phase of the liquid since smaller ice crystals are formed.

Figure 3:
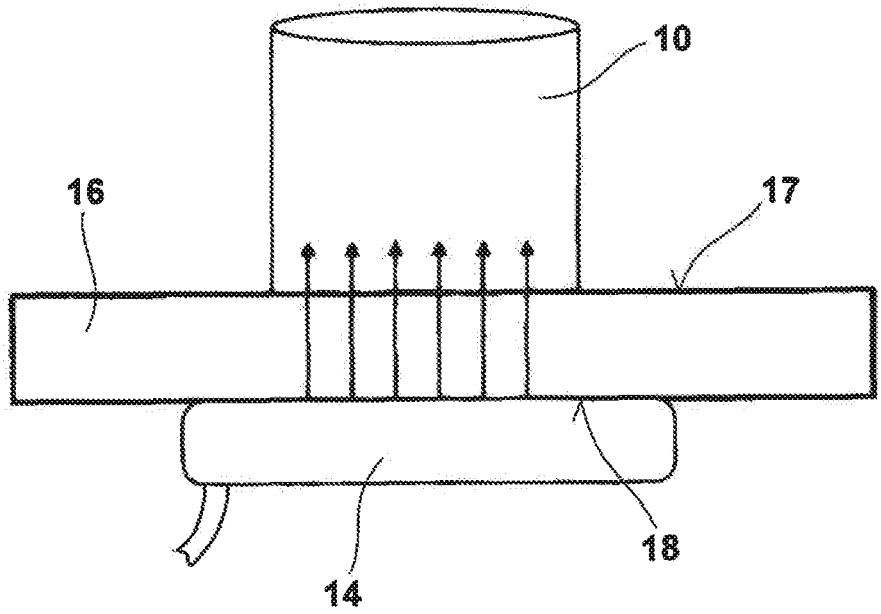
FIG. 3 is a detailed view of a part of a reception apparatus with a product standing on a reception plate.

FIG. 3 shows by way of example an enlarged view of the product 10 that is placed on an upper side 17 of the reception plate 16. A sound generator 14 is arranged on the lower side 18 of the reception plate 16 and can send sound, in particular ultrasound, directly into the product 10 through the reception plate 16. The product 10 can, for example, be stored in a container and can stand on the upper side 17 of the reception plate 16. If a plurality of products 10 are placed on the reception plate 16, a plurality of sound generators 14 associated with the respective products 10 can also be arranged on the lower side 18 of the reception plate 16.

Figure 4:
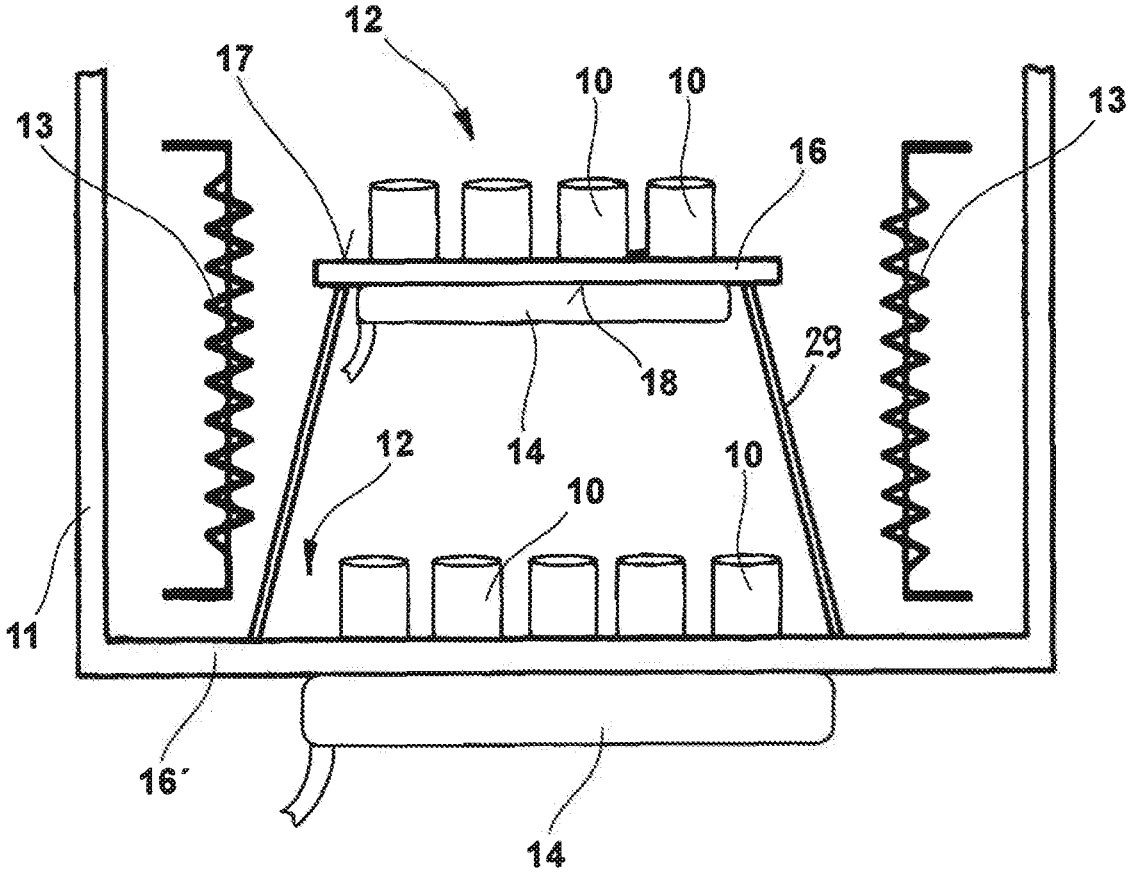
FIG. 4 is a further embodiment of a freeze-drying system with an alternative embodiment of the reception apparatus.

FIG. 4 shows an alternative embodiment of the reception apparatus 12 and a reception plate 16 attached to a rack 29 is shown and a plurality of products 12 stand on the upper side 17 of the reception plate 16. A sound generator 14 is arranged on the lower side 18 of the reception plate 16.

The example in accordance with FIG. 4 simultaneously also shows the possibility that a base plate 16' of the vacuum chamber 11 forms the reception apparatus 12 for receiving the products 10 and the sound generator 14 is arranged at the outer side below the base plate 16'. The base plate 16' thus forms an alternative form of the reception plate 16 and in the sense of the invention thus also a part of the reception apparatus 12.

Figure 5:
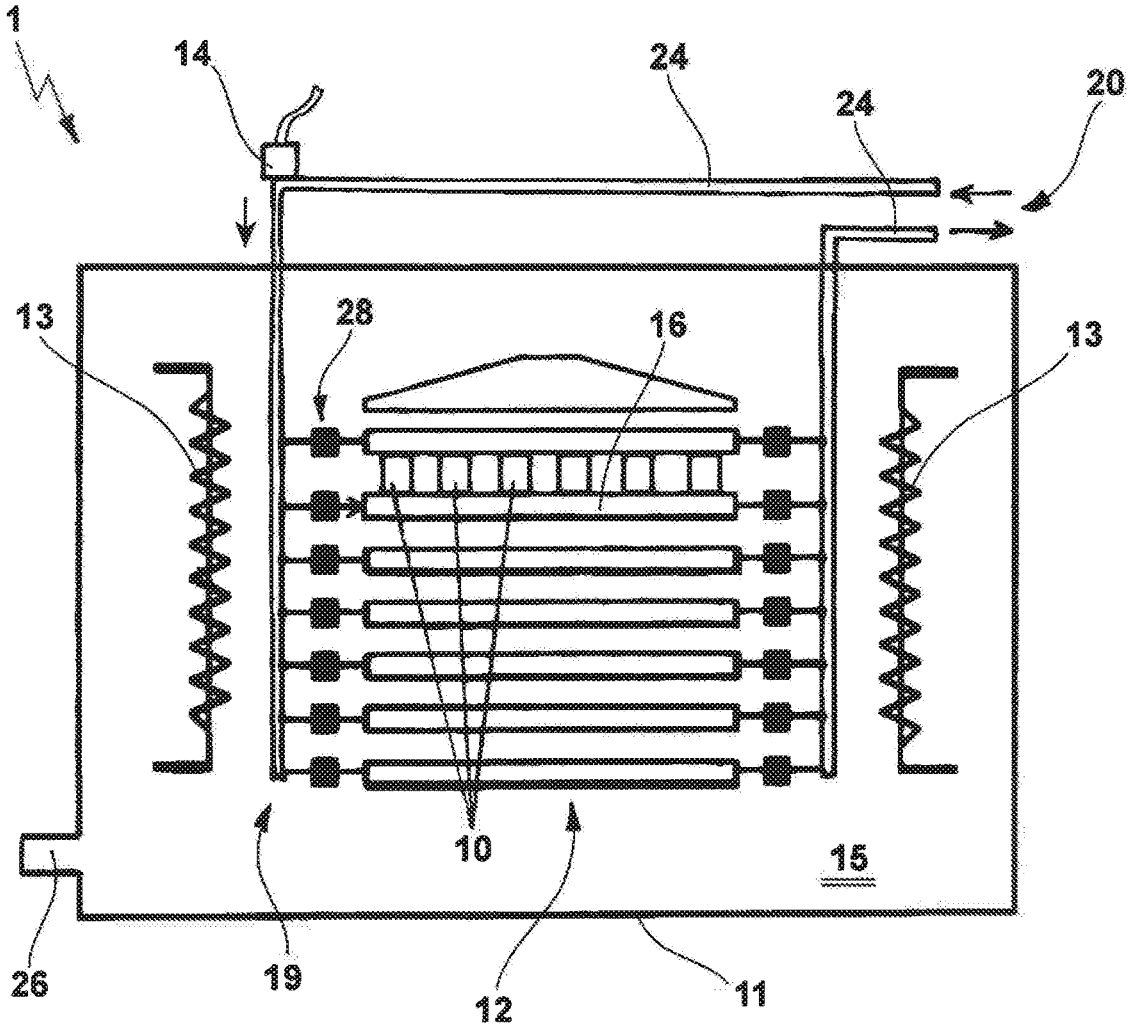
FIG. 5 is a freeze-drying system with an alternative arrangement of a sound generator.

FIG. 5 represents a further embodiment of a freeze-drying system 1 with a vacuum chamber 11 in which the reception apparatus 15 is formed and the reception apparatus 12 is introduced in the reception space 15. The reception apparatus 12 in turn has a plurality of reception plates 16 and each of the reception plates 16 is connected by single lines to the conducting device 19 that comprises a plurality of fluid lines 24 through conducting the fluid 20. The condenser 13 is furthermore arranged in the vacuum chamber 11 and the vacuum chamber 11 has a vacuum connector 26 for evacuating and for venting thereof.

The products 10 are disposed on the upper side of the reception plates 16, with six products being shown by way of example.

In accordance with the embodiment, a sound generator 14 is arranged at a fluid line 24 and can introduce sound, in particular ultrasound, in the conducting device 19. In this respect, a conducting of the sound takes place via the fluid line itself, but in particular also via the fluid column that is conducted into the reception plates 16, see by way of example a fluid flow arrow before the second reception plate 16 on which the products 10 are placed. The possibility is thus used of introducing an ultrasound into all the reception plates 16 by a centrally arranged sound generator and the line branching of the conducting device 19, said ultrasound being able to be conducted via the line, and in particular via the liquid column, directly to the products 10 that are placed on the upper side of the reception plates 16.

An alternative sound treatment point 28 can be formed, for example, in or at each of the fluid lines 24 at which one sound generator is arranged per reception plate 16.

Figure 6:
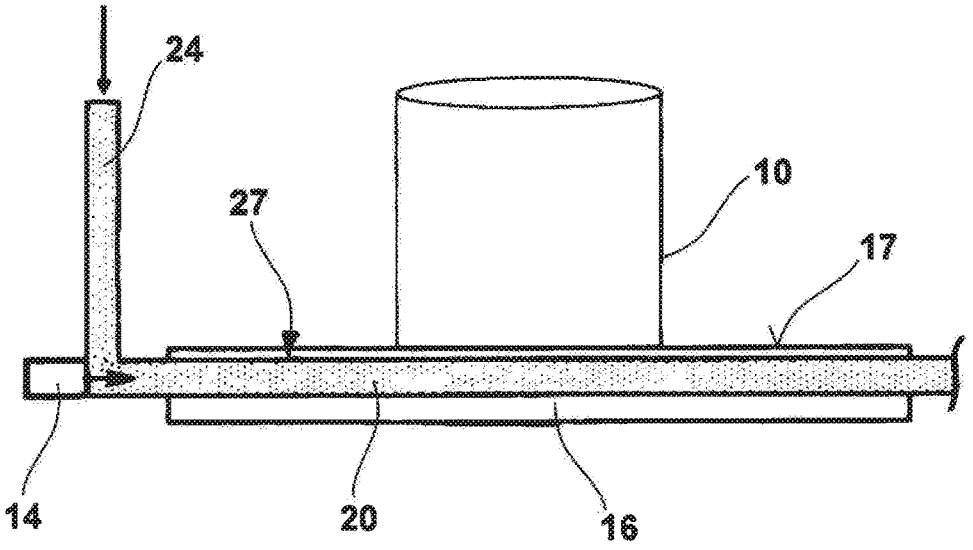
FIG. 6 is a detailed view of a fluid line at which a sound generator is arranged.

FIG. 6 shows for this purpose a detailed view of a reception plate 16 and a fluid passage 27 through which the fluid 20 is conducted and that is connected to the fluid line 24 is located in the reception plate 16. A product 10 stands on the upper side 17 of the reception plate 16 by way of example.

A sound generator 14 that can send a sound, in particular an ultrasound, into the region of the fluid 20 that flows through the fluid passage 27 within the reception plate 16 is arranged by way of example at an end side of a section of the fluid line 24 extending in a straight line. The schematic view illustrates the possibility of using the fluid column of the fluid to conduct the sound to the product 10 and the fluid can simultaneously be used as a heating and cooling fluid to heat and cool the product 10.

The invention is not restricted in its design to the preferred embodiment specified above. A number of variants is rather conceivable that also makes use of the solution shown with a generally differently designed embodiment. All the features and/or advantages, including any construction details or spatial arrangements, originating from the claims, the description or the drawings can be essential to the invention both per se and in the most varied combinations.

REFERENCE NUMERAL LIST

1 freeze-drying system
10 product
11 vacuum chamber
12 reception device
13 condenser
14 sound generator
15 reception space
16 reception plate
16' base plate
17 upper side
18 lower side
19 conducting device
20 fluid
21 intermediate wall
22 valve
23 refrigerant
24 fluid line
25 condenser chamber
26 vacuum connection
27 fluid passage
28 sound treatment point
29 rack

The invention claimed is:

1. A freeze-drying system for freeze-drying products containing liquid, wherein in a drying phase the products are kept at a temperature below or close to the freezing point of the liquid and exposed to a low-pressure atmosphere, so that drying by sublimation of the frozen liquid takes place, the freeze-drying system comprising:

a vacuum chamber in which at least one reception device for receiving the products containing liquid is introduced; and at least one sound generator by which the products can be treated with sound during the drying phase is arranged at the reception device;

wherein a coolable condenser is present at which liquid withdrawn from the products in the drying phase can be precipitated from a vapor phase; and the reception device comprises a conducting device for conducting a fluid to cool or to heat the products at the reception device, with the sound generator being arranged at the conducting device and designed to send a sound into the fluid.

2. The freeze-drying system in accordance with claim 1, wherein the reception device comprises one or more reception plates, with the products being able to be placed on an upper side of the reception plate, and with the at least one sound generator being arranged at a lower side of the reception plate disposed opposite the upper side.

3. The freeze-drying system in accordance with claim 1, wherein a reception space is formed in the vacuum chamber, with the condenser being introduced in the reception space together with the reception device and the products.

4. The freeze-drying system in accordance with claim 1, wherein the condenser is spatially formed such that is surrounds the reception device at an outer side.

5. The freeze-drying system in accordance with claim 1, wherein the reception device comprises a reception plate that is formed by a base plate of the vacuum chamber.

6. The freeze-drying system in accordance with claim 1, wherein the sound generator forms an ultrasound generator and sends a sound into the products at a sound frequency of at least 16 kHz by a solid-borne sound transfer in a reception plate of the reception device and/or via a fluid column of the fluid in a fluid line.

7. A method of freeze-drying products containing liquid using a freeze-drying system, wherein in a drying phase the products are kept at a temperature below or close to the freezing point of the liquid and exposed to a low-pressure atmosphere, so that drying by sublimation of the frozen liquid takes place, the freeze-drying system comprising:

at least one sound generator arranged at a reception device for receiving the products containing liquid in a vacuum chamber and with the products being treated with sound during the drying phase by a sound wave conducting through at least a part of the reception device by the sound generator; and wherein the reception device comprises a conducting device for conducting a fluid to cool or to heat the products at the reception device, with the sound generator being arranged at the conducting device and sending a sound into the fluid so that the sound is conducted through the fluid to a reception plate of the reception device and thus to the products.

* * * * *